US007861552B1

(12) United States Patent
Hughes

(10) Patent No.: US 7,861,552 B1
(45) Date of Patent: Jan. 4, 2011

(54) INSULATED FOOD CARRIER AND ORGANIZER

(76) Inventor: Sean O Hughes, 91-1027C Waaula St., Kapolei, HI (US) 96707

( * ) Notice: Subject to any disclaimer, the term of this patent is extended or adjusted under 35 U.S.C. 154(b) by 448 days.

(21) Appl. No.: 11/737,553

(22) Filed: Apr. 19, 2007

(51) Int. Cl.
*F25D 3/08* (2006.01)

(52) U.S. Cl. ..... 62/457.2; 62/371; 62/457.5

(58) Field of Classification Search ..... 62/457.2, 62/371, 457.3–457.5
See application file for complete search history.

(56) References Cited

U.S. PATENT DOCUMENTS

| | | | | |
|---|---|---|---|---|
| 1,979,549 | A | 11/1934 | Huckel | |
| 2,083,852 | A | 6/1937 | McClanahan | |
| 2,504,911 | A * | 4/1950 | Whitecar | 62/457.2 |
| 3,156,105 | A * | 11/1964 | Bahner | 62/371 |
| 3,187,518 | A * | 6/1965 | Bair et al. | 62/372 |
| 3,241,706 | A | 3/1966 | Monaco et al. | |
| 4,638,645 | A * | 1/1987 | Simila | 62/457.1 |
| 4,697,380 | A * | 10/1987 | Fenske | 43/55 |
| 4,923,086 | A | 5/1990 | Mahon et al. | |
| 5,024,067 | A | 6/1991 | Maier, II | |
| 5,042,260 | A * | 8/1991 | George, Sr. | 62/60 |
| 5,246,151 | A * | 9/1993 | Jabara | 224/544 |
| 5,406,996 | A * | 4/1995 | Wagner et al. | 141/364 |
| 5,727,857 | A | 3/1998 | Smith | |
| 6,026,978 | A * | 2/2000 | Clegg et al. | 220/592.1 |
| 6,044,650 | A * | 4/2000 | Cook et al. | 62/130 |
| 6,237,765 | B1 * | 5/2001 | Hagen et al. | 206/315.11 |
| 6,349,559 | B1 * | 2/2002 | Hasanovic | 62/457.7 |
| 6,474,097 | B2 * | 11/2002 | Treppedi et al. | 62/457.7 |
| 6,851,276 | B2 * | 2/2005 | Perrins | 62/457.5 |
| 7,178,673 | B1 * | 2/2007 | Miller | 206/545 |

FOREIGN PATENT DOCUMENTS

| | | |
|---|---|---|
| AU | 2004202213 | 5/2004 |
| JP | 2005069662 | 3/2005 |
| WO | WO03/023296 | 3/2003 |

* cited by examiner

*Primary Examiner*—Melvin Jones
(74) *Attorney, Agent, or Firm*—Michael I Kroll

(57) ABSTRACT

An insulated carrier having an interior lip for supporting a planar organizer having a plurality of spaced apart apertures for receiving user provided containers and organizer aperture covers for covering said containers. The carrier having a lid for covering said carrier and having segregated storage compartments for utilitarian use, such as cutlery storage. The storage compartments having a latch door providing access therein.

15 Claims, 10 Drawing Sheets

INSULATED FOOD CARRIER AND ORGANIZER

BACKGROUND OF THE INVENTION

1. Field of the Invention

The present invention relates generally to insulated coolers and, more specifically, to an insulated carrier with an interior lip for supporting a planar organizer having a plurality of spaced apart apertures for receiving user provided containers and organizer-aperture covers for covering said user provided containers. The carrier has a covering lid with segregated storage compartments for utilitarian use, such as cutlery storage and a latched door providing access to the lid storage compartments.

2. Description of the Prior Art

There are other storage receptacles designed for cooling. Typical of these is U.S. Pat. No. 1,979,549 issued to Huckel on Nov. 6, 1934.

Another patent was issued to McClanahan on Jun. 15, 1937 as U.S. Pat. No. 2,083,852. Yet another U.S. Pat. No. 3,241,706 was issued to Monaco, et al. on Mar. 22, 1966 and still yet another was issued on Jan. 27, 1987 to Simila as U.S. Pat. No. 4,638,645.

Another patent was issued to Mahon, et al. on May 8, 1990 as U.S. Pat. No. 4,923,086. Yet another U.S. Pat. No. 5,024,067 was issued to Maier, II on Jun. 18, 1991. Another was issued to Smith on Mar. 17, 1998 as U.S. Pat. No. 5,727,857 and still yet another was issued on Feb. 22, 2000 to Clegg, et al. as U.S. Pat. No. 6,026,978.

Another patent was issued to Hasanovic on Feb. 26, 2002 as U.S. Pat. No. 6,349,559. Yet another International Patent Application No. WO03/023296 was issued to Abfalter on Mar. 20, 2003. Another was issued to Hooper on Dec. 9, 2004 as Australian Patent No. AU 2004202213 and still yet another was issued on Mar. 17, 2005 to Kimura as Japan Patent No. JP2005069662.

U.S. Pat. No. 1,979,549

Inventor: John F. Huckel

Issued: Nov. 6, 1934

In apparatus of the character described, a water tight compartment having a vertical partition spaced from the bottom of the compartment to provide a primary chamber for retaining a refrigerant and a secondary chamber having connection at the bottom of the partition with the primary chamber for flow of liquid from the primary to the secondary chamber, the secondary chamber having a drain outlet in its bottom for the liquid, a valve for said outlet, and valve operating means extending upwardly in the secondary chamber for access at the top of the compartment.

U.S. Pat. No. 2,083,852

Inventor: Effie McClanahan

Issued: Jun. 15, 1937

In a device of the class described, a cabinet, a set of hinged doors at the top of said cabinet, the underside of said doors provided with flanges, a set of trays mounted in said cabinet, said trays provided with a bent over portion, said flanges adapted to rest on the bent over portion of said trays when the said doors are in a closed position.

U.S. Pat. No. 3,241,706

Inventor: Foster F. Monaco, et al.

Issued: Mar. 22, 1966

A display-type food-service receptacle comprising an upwardly open outer vessel and a complementary domed cover each made of a transparent plastic material which maintains a selected temperature within said receptacle; said vessel being of rectangular outline and integrally formed with an outwardly projecting peripheral flange which rises above two longitudinal and two traverse ledges extending integrally inwardly from said flange and defining a continuous frame around the open top of the vessel, said cover fitting inside said flange above said ledges; and a plurality of upwardly open juxtaposed flanged plastic trays of rectangular configuration slidably suspended by their respective flanges from said longitudinal ledges in spaced relationship with the walls and bottom of said vessel, the combined width of said trays measured parallel to said longitudinal ledges being less than the spacing of said transverse ledges, thereby always providing a venting passage enabling the circulation of fluid from the space underneath said trays to the region above said trays, said space underneath being adapted to receive a temperature-controlling fluid, said cover resting on the flanges of said trays in a closure position.

U.S. Pat. No. 4,638,645

Inventor: Eric J. Simila

Issued: Jan. 27, 1987

A beverage container cooler comprises an outer container and an inner container co-axially mounted within the outer container for receiving a single beverage container such as a beverage containing can in a sleeve-like fashion. The spacing between the opposed inner and outer surfaces of the containers comprises a coolant chamber for receiving ice, for example, to keep the beverage in the container cool.

U.S. Pat. No. 4,923,086

Inventor: Terrence K. Mahon et al.

Issued: May 8, 1990

An ice guard to receive a food container in crushed, flaked, cubed, or broken ice is provided having a side wall which includes a first end and a second end. The first end receives a first size of food container. The second end includes an inwardly intruding rim which receives a second, smaller size of food container. The side wall can define a plurality of apertures to cool the food container. By simply inverting the ice guard, different size food containers can be accommodated.

U.S. Pat. No. 5,024,067

Inventor: Simeon E. Maier, II

Issued: Jun. 18, 1991

A container with a freezable liquid for use in or out of an ice chest for temporary cooling purposes. The container of the invention is generally to have a top and a bottom and four sides connected to form a rectangular box type structure. The sides are to have dovetail joints that work as a fastening means to connect more than one together, thus making for a longer lasting cooling means. The invention can also be made without dovetail joints in groups of one or more. These groups would also have a long lasting cooling effect as they would work similar to a block of water-ice. The container of the invention is to have a cylindrical opening in the top that rescinds down toward the bottom, said opening is to be about the size of a pop can. This cylindrical opening is the heart of the invention as it allows a cooling effect from around the periphery as well as the bottom.

U.S. Pat. No. 5,727,857

Inventor: Lorena D. Smith

Issued: Mar. 17, 1998

A portable knockdown display apparatus for displaying food and keeping the food fresh on ice during use of the apparatus. The apparatus includes a rack for holding food receptacles, a cover removably seated on the rack for protecting the food receptacles, a plurality of individual legs, and a container having a bottom and a plurality of sidewalls that define a cavity for retaining ice during use of the apparatus. The container has a plurality of attachment wells for releasably attaching the legs to the container so that the container is elevated to table height. During use of the apparatus, the container is capable of receiving the rack in its cavity to maintain the food receptacles in physical proximity to the ice. When knocked down into a portable formation, the container is capable of receiving the rack, the cover, and the legs in its cavity to facilitate ease of transportation and storage. A number of straps are used removably to secure the apparatus in its portable formation, and a handle on the sidewall of the container allows a user easily to carrying the apparatus.

U.S. Pat. No. 6,026,978

Inventor: Geniel Clegg et al.

Issued: Feb. 22, 2000

A cooler for providing side compartments for holding ice separate from an inner container for holding food and beverages. The cooler includes an outer chest with an open top and an outer lid covering the open top. An open inner frame is position in the open top of the outer chest and spaced apart from the outer chest. The inner frame has a plurality of outwardly extending generally connecting tabs coupled to the outer chest to connect the inner frame to the outer chest. Each adjacent pair of connecting tabs define therebetween a passage between the inner frame and the outer chest. An inner container is provided in the outer chest and is positioned in the center hole of the inner frame. The inner container is spaced apart from the outer chest to define an outer reservoir therebetween.

U.S. Pat. No. 6,349,559

Inventor: Simbad Hasanovic

Issued: Feb. 26, 2002

A cooler chest with an ice-surrounding food compartment (10) includes an outer container 20 that supports an outer lid (40). An inner container (60) having an inner lid (80) is carried within the outer container (20). In use, an ice storage area is defined within an area between the inner and outer containers; food is contained within the inner container. Due to the curvature of the sidewall of the outer container and due to the sloping sidewall of the inner lid carried by the inner container, a flared ice entry passage is defined which aids in the addition of ice.

International Patent Application Number WO 03/023296

Inventor: James Abfalter

Published: Mar. 20, 2003

A cooler chest includes an outer unit and a separate inner unit having a height smaller than the height of the outer unit and a space over the inner unit for storing ice cubes, the space being defined in part by porous side walls that allow for drainage of water, resulting from the melting ice cubes, from the ice cube storage area.

Australian Patent Number AU2004202213

Inventor: Frederick Arnold Hooper

Published: Dec. 9, 2004

The present invention discloses an ice chest having a divided wall, preferably formed from an end wall of a container sized to fit within the ice chest the space between the interior of the ice chest and the dividing wall constitutes an ice receiving cavity which, when filled with ice can function as an ice bucket to provide extra cooling to one bottle in contact with ice, remaining bottles are maintained cool, but a higher temperature, and dry within the container melt water from the ice is separated by the container from the general contents of the ice chest and thus is not contaminated by bacteria and may be drunk following dispensing via a drain cock. A method of cooling is also disclosed.

Japan Patent Number JP2005069662

Inventor: Hideo Kimura

Issued: Mar. 17, 2005

Problem to be Solved: To provide a wine cooler allowing a bottle to be inserted without being disturbed by ice.

Solution: A mounting fixture (A) is provided on an inner bottom of a container (1) with an open top (1). A mounting fixture (B) is provided on the opening. A bag or bag-shaped net (2) is mounted to the fixtures using a spherical body (Q).

While these insulated coolers may be suitable for the purposes for which they were designed, they would not be as suitable for the purposes of the present invention, as hereinafter described. The present invention provides an insulated carrier having an interior lip for supporting a planar organizer having a plurality of spaced apart apertures for receiving user provided containers and organizer aperture covers for covering said containers. The carrier having a lid for covering said carrier and having segregated storage compartments for utilitarian use, such as cutlery storage. The storage compartments having a latch door providing access therein.

SUMMARY OF THE PRESENT INVENTION

A primary object of the present invention is to provide an insulated carrier or cooler for food items.

Another object of the present invention is to provide an insulated carrier having an interior lip for supporting a planar organizer having a plurality of spaced apart apertures for receiving user provided containers.

Yet another object of the present invention is to provide an insulated carrier having a lid for covering said carrier.

Still yet another object of the present invention is to provide an insulated carrier having segregated storage compartments for utilitarian use, such as cutlery storage.

Another object of the present invention is to provide an insulated carrier that the storage compartments have a latch door providing access therein.

Additional objects of the present invention will appear as the description proceeds.

The present invention overcomes the shortcomings of the prior art by providing an insulated carrier having an interior lip for supporting a planar organizer having a plurality of spaced apart apertures for receiving user provided containers and organizer aperture covers for covering said containers. The carrier having a lid for covering said carrier and having segregated storage compartments for utilitarian use, such as cutlery storage. The storage compartments having a latch door providing access therein.

The foregoing and other objects and advantages will appear from the description to follow. In the description reference is made to the accompanying drawing, which forms a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawing, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWING FIGURES

In order that the invention may be more fully understood, it will now be described, by way of example, with reference to the accompanying drawing in which.

DESCRIPTION OF THE REFERENCED NUMERALS

Figure 1:
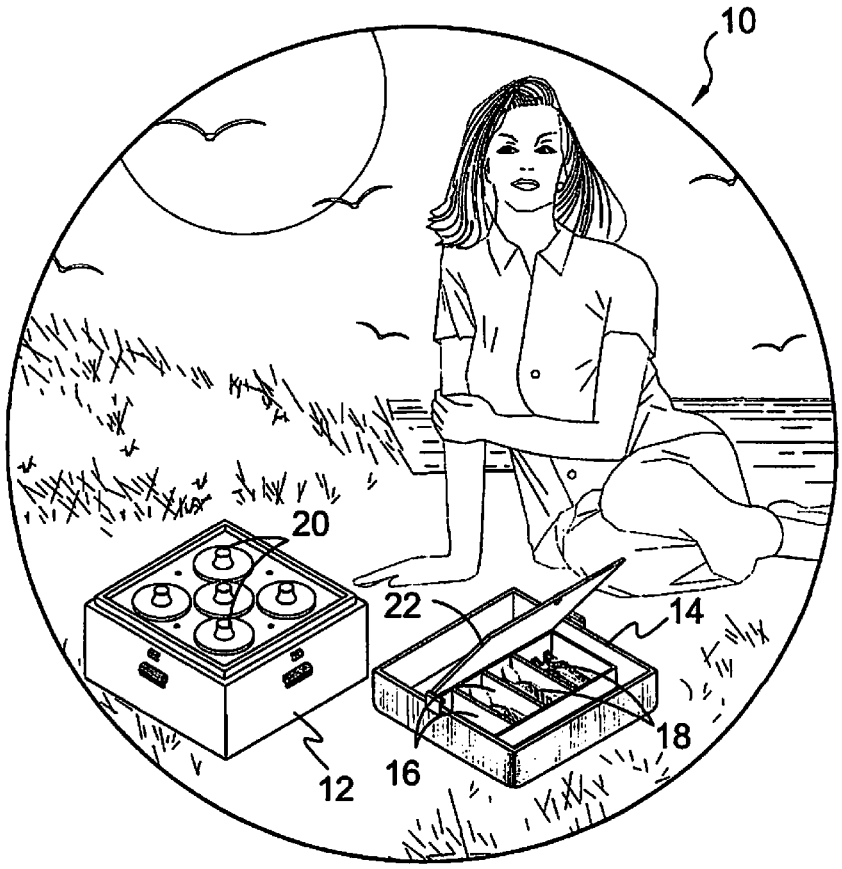
FIG. 1 is an illustrative view of the present invention.

Turning now descriptively to the drawings, in which similar reference characters denote similar elements throughout the several views, the figures illustrate the Insulated Food Carrier and Organizer of the present invention. With regard to the reference numerals used, the following numbering is used throughout the various drawing figures.

| | |
|---|---|
| 10 | Insulated Food Carrier and Organizer of the present invention |
| 12 | base |
| 14 | lid for 12 |
| 16 | storage compartment |
| 18 | cutlery |
| 20 | food aperture cover |
| 22 | latching door of 14 |
| 24 | securing clip |
| 25 | clip catch |
| 26 | carrying handle |
| 28 | lift handle |
| 30 | insulation |
| 32 | food container |
| 34 | bottom rack |
| 36 | bottom lip |
| 38 | top rack |
| 40 | top lip |
| 42 | drain recess |
| 44 | drain plug |
| 46 | interior of 12 |
| 48 | container aperture |
| 50 | cover aperture |
| 52 | ice |
| 54 | swivel latch |

DETAILED DESCRIPTION OF THE PREFERRED EMBODIMENT

The following discussion describes in detail one embodiment of the invention (and several variations of that embodiment). This discussion should not be construed, however, as limiting the invention to those particular embodiments, practitioners skilled in the art will recognize numerous other embodiments as well. For definition of the complete scope of the invention, the reader is directed to appended claims.

FIG. 1 is an illustrative view of the present invention 10. The present invention is an insulated food carrier and organizer 10 comprising a base 12 having an interior lip for supporting a planar organizer having a plurality of spaced apart apertures for receiving user provided containers and organizer aperture covers 20 for covering said containers. A lid is provided 14 for covering the base 12 and has segregated storage compartments 16 for utilitarian use, such as cutlery 18 storage. The storage compartments 16 have a latching door 22 providing access therein.

Figure 2:
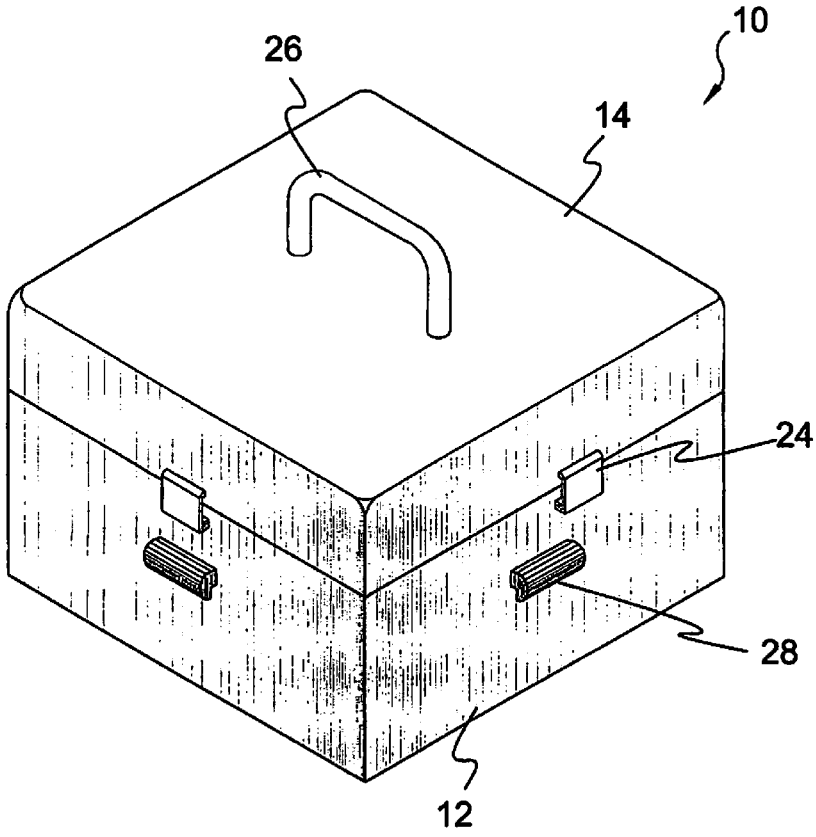
FIG. 2 is an assembled perspective view of the present invention.

FIG. 2 is an assembled perspective view of the present invention 10. Shown is the lid 14 secured to the base 12 with a plurality of clips 24. A carrying handle 26 is disposed on the top of the lid 14 and a plurality of lift handles 28 are disposed on the sides of the base 12.

Figure 3:
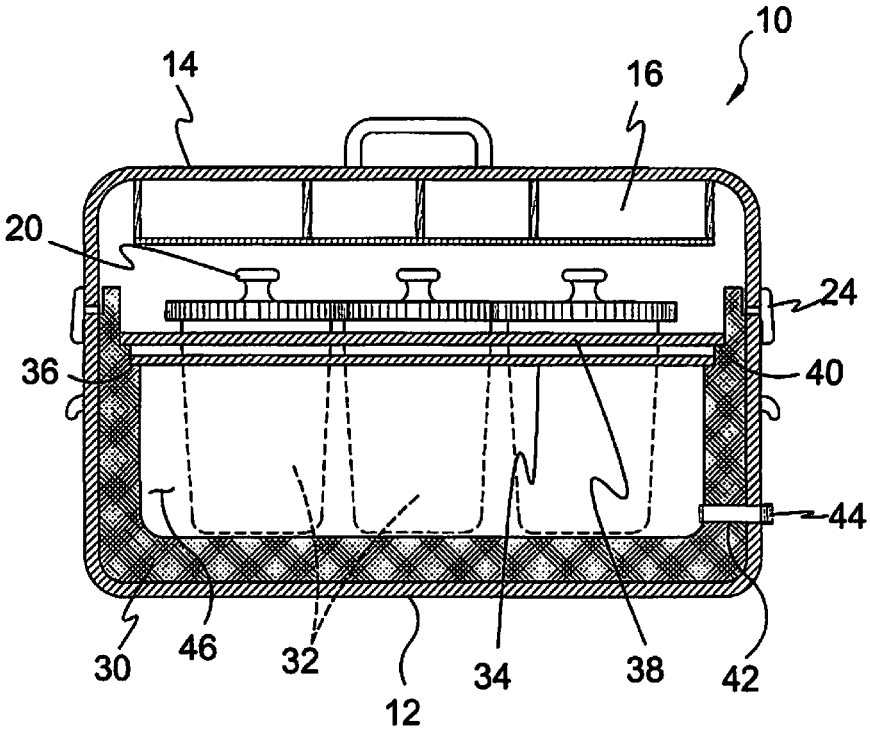
FIG. 3 is a sectional view of the present invention.

FIG. 3 is a sectional view of the present invention 10. The base 12 is insulated 30 and has a drain recess 42 and drain plug 44 for removing melted ice. A bottom rack 34 is seated on a bottom lip 36 and standardized food containers 32 commonly used in the industry are seated therein. A top rack 38 is situated above the bottom rack 34 and rests on a top lip 40. Aperture covers 20 protect the food in the containers 32 and retain the thermal integrity of the base interior 46. The lid 14 is secured to the base 12 with securing clips 24 and includes a plurality of storage compartments 16.

Figure 4:
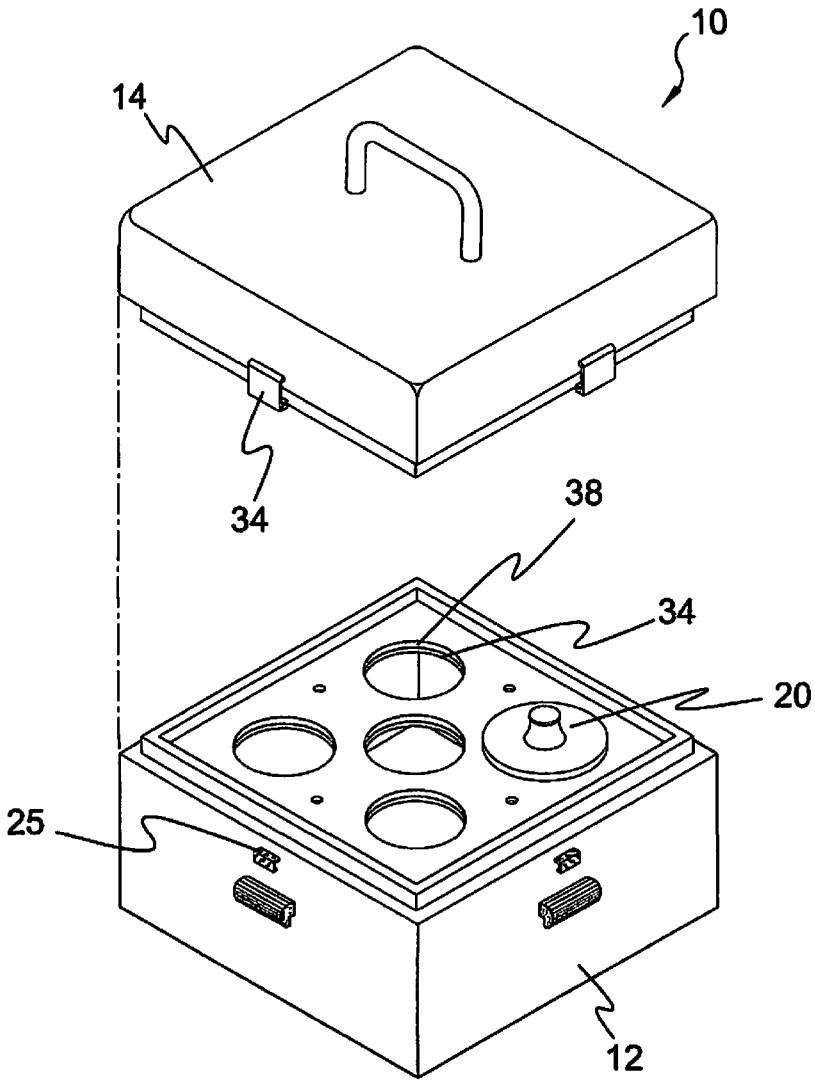
FIG. 4 is an exploded view of the present invention.

FIG. 4 is an exploded view of the present invention 10. Shown is the present invention 10 with the lid 14 removed from the base 12 by releasing the securing clips 24 from their respective clip catches 25. The top rack 38 and bottom rack 34 are installed in their stacked positions and one aperture cover 20 is shown in place.

Figure 5:
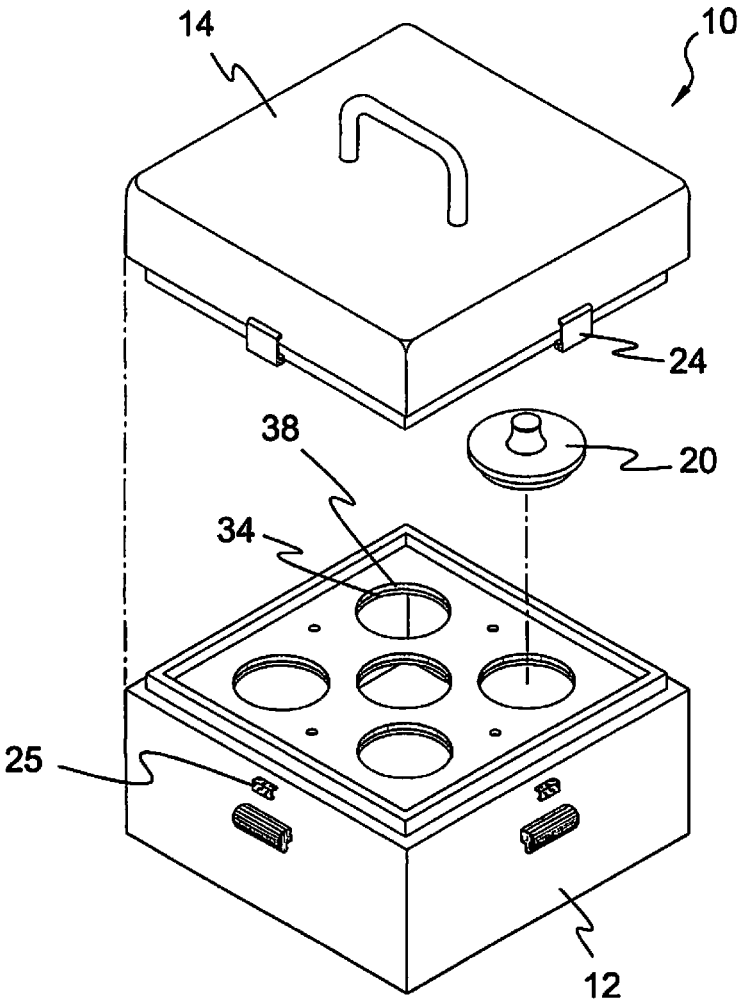
FIG. 5 is a partially exploded view of the present invention.

FIG. 5 is a partially exploded view of the present invention 10. Shown is the present invention 10 with the lid 14 removed from the base 12 by releasing the securing clips 24 from their respective clip catches 25. The top rack 38 and bottom rack 34 are installed in their stacked positions and one aperture cover 20 is shown removed from its respective aperture.

Figure 6:
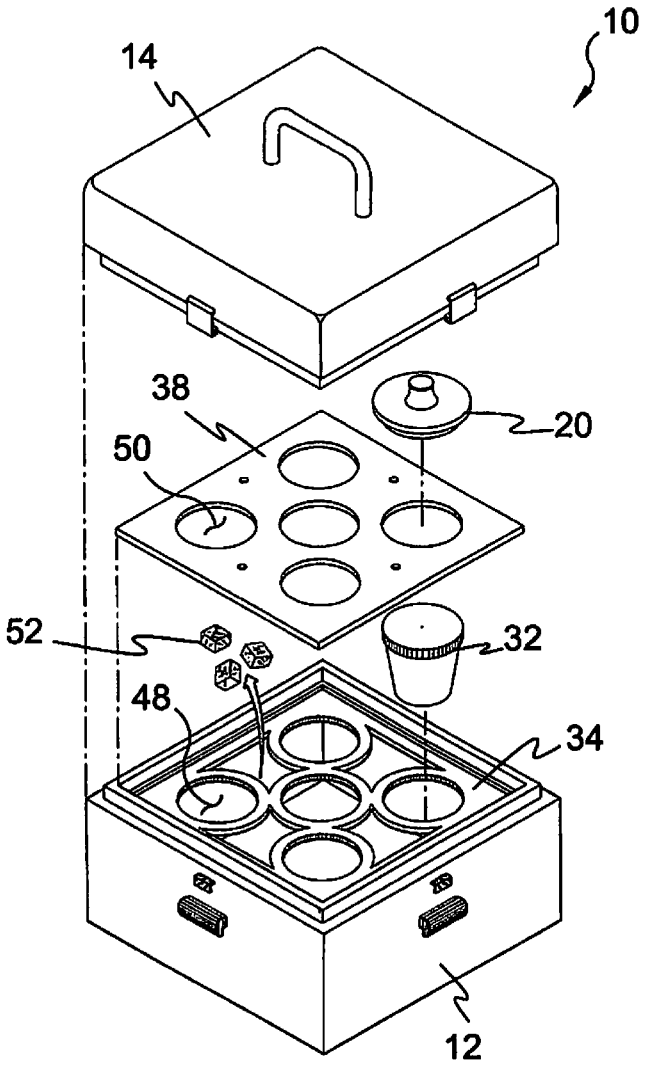
FIG. 6 is a partially exploded view of the present invention.

FIG. 6 is a partially exploded view of the present invention 10. The bottom rack 34 is installed in the base 12 and ice 52 is being poured through the container apertures 48. A food container 32 is ready to placed in a container aperture 48 and the top rack 38 is then installed and the aperture covers 20 are inserted into their respective cover apertures 50. The lid 14 can then be secured to the base 12 and the present invention 10 is ready for transport and storage.

Figure 7:
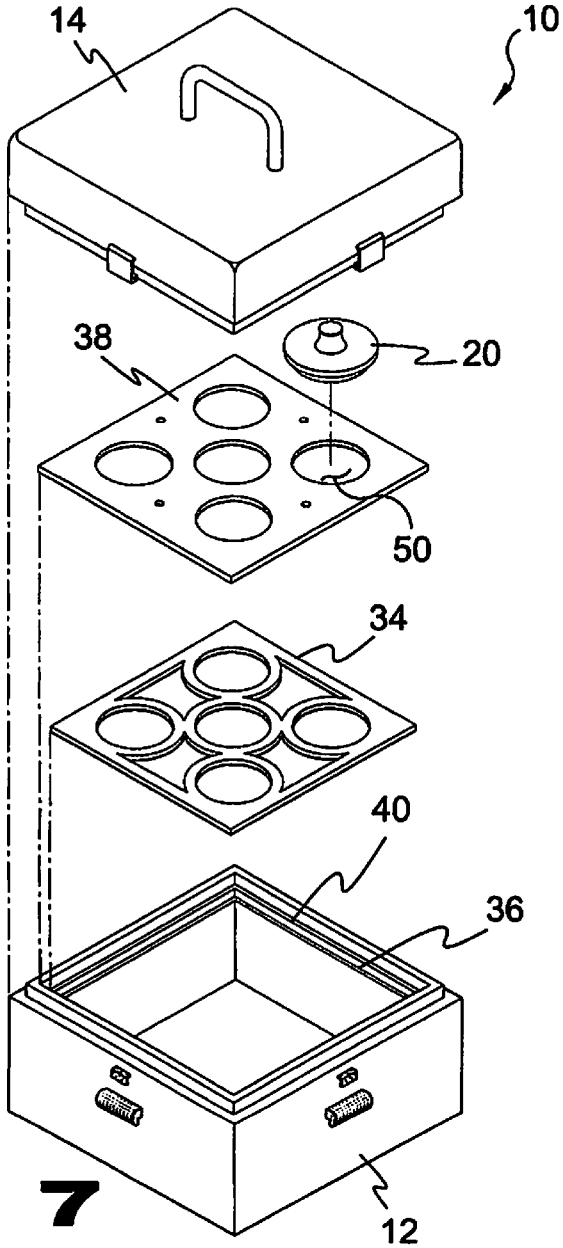
FIG. 7 is a fully exploded view of the present invention.

FIG. 7 is a fully exploded view of the present invention 10. Shown is the base 12 with a bottom lip 36 for receiving the bottom rack 34 and a top lip 40 for receiving the top rack 38. The aperture cover 20 gets inserted to the cover aperture 50 to protect the food in the container thereunder. The lid 14 is then secured to the base 12.

Figure 8:
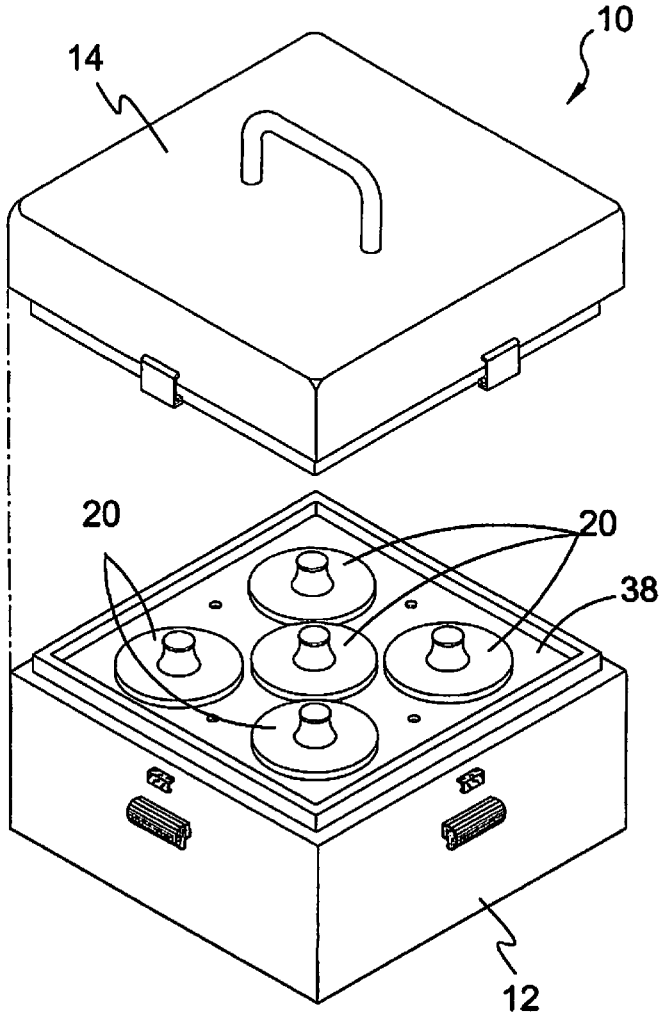
FIG. 8 is an exploded view of the present invention.

FIG. 8 is an exploded view of the present invention 10. Shown are the bottom and top rack 38 seated in place in the base 12 with the aperture covers 20 installed. The lid 14 can then be secured to the base 12.

Figure 9:
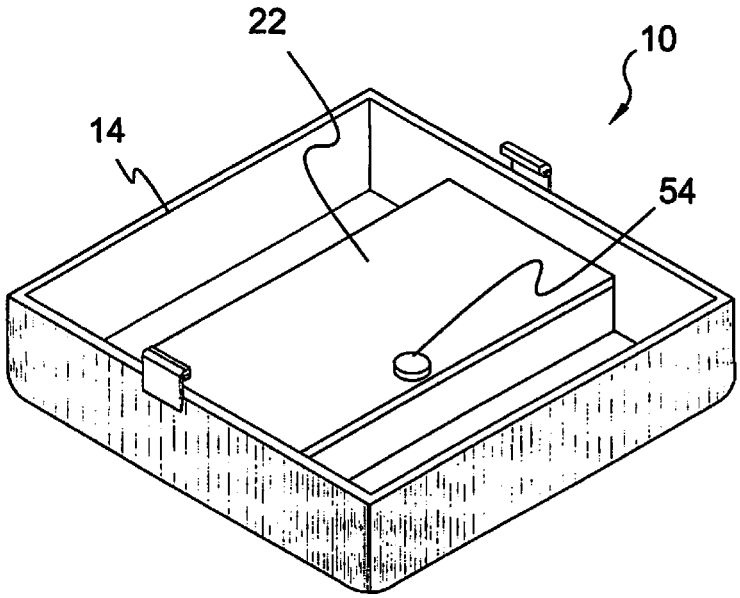
FIG. 9 is a bottom view of the cooler carrier of the present invention.

FIG. 9 is a bottom view of the cooler carrier lid 14 of the present invention 10. Shown is the latching door 22 for the cutlery storage compartments having a swivel latch 54.

Figure 10:
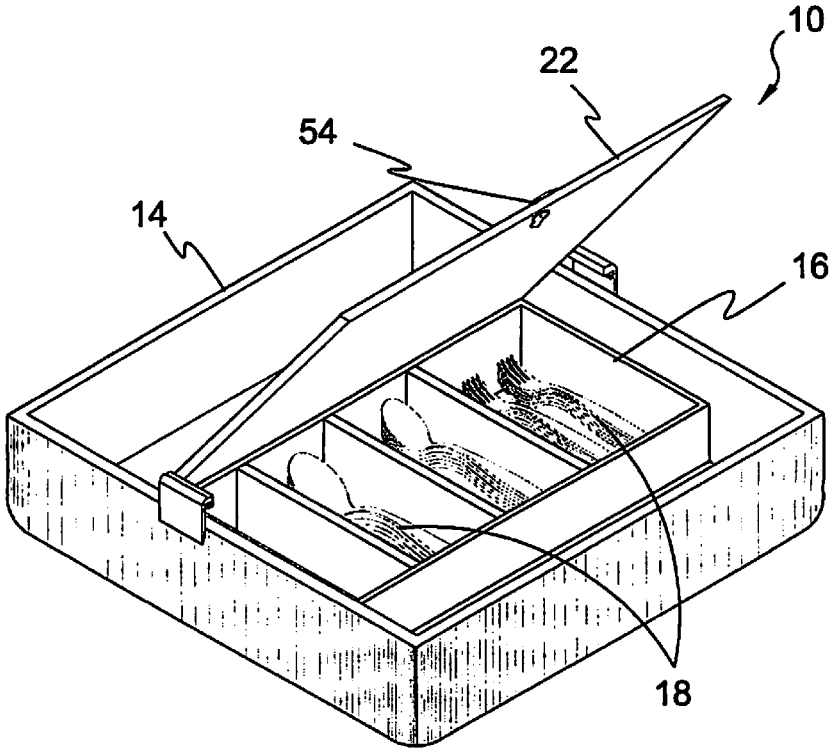
FIG. 10 is bottom view of the cooler carrier of the present invention.

FIG. 10 is bottom view of the cooler carrier lid 14 of the present invention 10. Shown is the latching door 22 for the cutlery storage compartments 16 having a swivel latch 54 in the open position. Cutlery 18 and other accessory items may be stored therein.

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention

The invention claimed is:

1. An insulated food carrier and organizer comprising:

a) a base having a bottom with four walls projecting peripherally therefrom defining an interior storage region for receiving a cooling agent such as ice;

b) a lid for selectively covering the top of said base;

c) means for suspending standard take-out food containers within said interior of said base;

d) covers to protect the food in said containers;

e) means for securing said covers over said containers;

f) an accessory storage compartment disposed on the underside of said lid, said accessory storage compartment having a hinged door, said accessory storage compartment door further includes means for selectively securing said door in a closed position;

g) wherein said base is insulated;

h) wherein said lid is insulated; and i) wherein said base has a bottom retaining lip interiorly disposed near a top of said base.

2. The insulated food carrier and organizer recited in claim 1, wherein said base has a top retaining lip interiorly disposed near the top of said base, superior to said bottom retaining lip.

3. The insulated food carrier and organizer recited in claim 1, wherein a bottom rack is provided to sit on said bottom lip.

4. The insulated food carrier and organizer recited in claim 3, wherein said bottom rack includes a plurality of apertures sized appropriately for suspending standard sized take-out food containers.

5. The insulated food carrier and organizer recited in claim 2, including a top rack that is provided to sit on said top retaining lip of said base.

6. The insulated food carrier and organizer recited in claim 5, wherein said top rack includes a plurality of apertures for receiving said covers.

7. The insulated food carrier and organizer recited in claim 1, wherein said lid further includes a carrying handle disposed on a top portion thereof.

8. The insulated food carrier and organizer recited in claim 1, wherein said base having sides, said base further includes a plurality of lifting handles disposed on the sides thereof.

9. The insulated food carrier and organizer recited in claim 1, further comprising means for selectively securing said lid to said base.

10. The insulated food carrier and organizer recited in claim 9, wherein said lid securing means is a plurality of clips disposed on said lid and mating clip catches disposed on outer walls of said base.

11. The insulated food carrier and organizer recited in claim 1, further including a means for draining melted ice from the interior of said base.

12. The insulated food carrier and organizer recited in claim 11, wherein said draining means is a drain recess communicating between the interior of said base and an exterior.

13. The insulated food carrier and organizer recited in claim 12, wherein said draining means further includes a selectively removable drain plug for said drain recess that is accessible from the exterior of said base.

14. An insulated food carrier and organizer comprising:

a) a base having a bottom with four walls projecting peripherally therefrom defining an interior storage region for receiving a cooling agent such as ice;

b) a lid for selectively covering the top of said base;

c) means for suspending standard take-out food containers within said interior of said base;

d) covers to protect the food in said containers;

e) means for securing said covers over said containers;

f) an accessory storage compartment disposed on an underside of said lid;

g) said accessory storage compartment has a plurality of individual compartments for storing cutlery;

h) said accessory storage compartment having a hinged door; and i) said accessory storage compartment door further includes means for selectively securing said door in a closed position.

15. The insulated food carrier and organizer recited in claim 14, wherein said accessory storage compartment door locking means is a swivel latch.

* * * * *